US010088224B1

(12) United States Patent
Platts

(10) Patent No.: US 10,088,224 B1
(45) Date of Patent: Oct. 2, 2018

(54) REFRIGERATOR APPLIANCE HAVING MULTIPLE CHILLED CHAMBERS

(71) Applicant: Haier US Appliance Solutions, Inc., Wilmington, DE (US)

(72) Inventor: Lauren Nicole Platts, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/659,708

(22) Filed: Jul. 26, 2017

(51) Int. Cl.
*F25D 25/02* (2006.01)
*F25D 11/02* (2006.01)
*F25D 23/02* (2006.01)

(52) U.S. Cl.
CPC ..... *F25D 25/025* (2013.01); *F25D 11/02* (2013.01); *F25D 23/02* (2013.01); *F25D 23/025* (2013.01); *F25D 2323/021* (2013.01); *F25D 2500/02* (2013.01)

(58) Field of Classification Search
CPC ..... F25D 25/025; F25D 23/02; F25D 23/025; F25D 2323/021; F25D 2500/02; F25D 11/02
See application file for complete search history.

(56) References Cited

U.S. PATENT DOCUMENTS 9,074,810 B2 * 7/2015 Hwang ..... F25D 23/02
2010/0090575 A1 * 4/2010 Uthuppan ..... F25D 23/04 312/404
2011/0210655 A1 * 9/2011 Brown ..... F25D 25/025 312/334.8
2012/0042670 A1 * 2/2012 Lee ..... F25D 25/025 62/125
2012/0060544 A1 * 3/2012 Lee ..... F25D 23/02 62/440
2012/0099255 A1 * 4/2012 Lee ..... F25D 25/025 361/679.01
2012/0181910 A1 * 7/2012 Kim ..... F25D 23/02 312/404
2013/0257253 A1 * 10/2013 Haltmeyer ..... F25D 25/025 312/404
2013/0320833 A1 * 12/2013 Ward ..... F25D 23/02 312/408
2014/0125212 A1 * 5/2014 Choo ..... F25D 23/00 312/405.1
2015/0115790 A1 * 4/2015 Ogg ..... F25D 23/069 312/404
2015/0241119 A1 * 8/2015 Sankhgond ..... F25D 25/025 312/114
2016/0265837 A1 * 9/2016 Bhatt ..... F25D 23/025
2017/0059237 A1 * 3/2017 Anderson ..... F25D 29/005
2017/0122653 A1 * 5/2017 Cizik ..... F25D 25/025
(Continued)

FOREIGN PATENT DOCUMENTS

JP 03110375 A * 5/1991

*Primary Examiner* — Hanh V Tran
(74) *Attorney, Agent, or Firm* — Dority & Manning, P.A.

(57) ABSTRACT

A refrigerator appliance is provided herein. The refrigerator appliance may include a cabinet extending along a lateral direction between a first side portion and a second side portion, as well as along a transverse direction from a rear portion to a front portion. The cabinet may define a plurality of operably-independent chilled chambers, including a first chilled chamber, a second chilled chamber, and a third chilled chamber.

18 Claims, 9 Drawing Sheets

(56) References Cited

U.S. PATENT DOCUMENTS

| | | | | |
|---|---|---|---|---|
| 2017/0160002 | A1* | 6/2017 | Kang | F25D 25/025 |
| 2017/0292756 | A1* | 10/2017 | Fenko | F25D 3/08 |
| 2017/0307285 | A1* | 10/2017 | Cizik | F25D 25/025 |
| 2017/0321958 | A1* | 11/2017 | Ramm | F25D 23/069 |
| 2018/0017315 | A1* | 1/2018 | Choi | F25D 25/025 |
| 2018/0038630 | A1* | 2/2018 | Biotti | F25D 25/025 |

* cited by examiner

REFRIGERATOR APPLIANCE HAVING MULTIPLE CHILLED CHAMBERS

FIELD OF THE INVENTION

The present subject matter relates generally to refrigerator appliances, and more particularly to refrigerator appliances having multiple chilled chambers.

BACKGROUND OF THE INVENTION

Certain refrigerator appliances utilize sealed systems for cooling chilled chambers of the refrigerator appliances. A typical sealed system includes an evaporator and a fan, the fan generating a flow of air across the evaporator and cooling the flow of air. The cooled air is then provided through an opening into the chilled chamber to maintain the chilled chamber at a desired temperature. Air from the chilled chamber is circulated back through a return duct to be re-cooled by the sealed system during operation of the refrigerator appliance, maintaining the chilled chamber at the desired temperature.

Certain refrigerators appliances also include one or more fresh food and/or freezer chambers configured for maintaining different temperatures for storing different types of food and drink. For example, a conventional refrigerator appliance may be formed as a side-by-side configuration wherein a fresh food chamber is positioned beside a freezer chamber. Both the fresh food chamber and the freezer chamber will generally extend from the top of the refrigerator appliance to the bottom of the refrigerator appliance. As another example, a conventional refrigerator appliance may be formed as a bottom-mount refrigerator appliance wherein a freezer chamber is positioned below a fresh food chamber.

However, problems exist with conventional refrigerator appliances. In the case of side-by-side refrigerator appliances, usable space is generally limited by the width of the chambers. In other words, a user may be unable to place certain objects within the refrigerator since the width of each chilled chamber is necessarily limited by the width of the other chamber. In the case of a bottom mount refrigerator appliance, it may be difficult to organize and/or access certain items. Small items, as an example, may fall to the bottom of the freezer chamber, where they may become lost or inaccessible. Moreover, since the freezer chamber must be viewed from above, it may be difficult for a user to easily determine what articles are items are within the freezer chamber.

In turn, further improvements for refrigerator appliances would be beneficial. For instance, it would be beneficial to have a refrigerator appliance addressing one or more of the above issues. Moreover, it may be beneficial to have a refrigerator appliance with one or more features for readily storing and viewing a broad range of articles at various chilled temperatures within a cabinet of the refrigerator appliance.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance may include a cabinet extending along a lateral direction between a first side portion and a second side portion, as well as along a transverse direction from a rear portion to a front portion. The cabinet may define a plurality of operably-independent chilled chambers. The plurality of operably-independent chilled chambers may include a first chilled chamber, a second chilled chamber, a full-width chilled chamber, and a third chilled chamber. The first chilled chamber may be positioned at the first side portion and accessible through a first chamber opening at the front portion. The second chilled chamber may be positioned at the second side portion and accessible through a second chamber opening at the front portion. The full-width chilled chamber may extend from the first side portion to the second side portion beneath the first chilled chamber and the second chilled chamber along a vertical direction. The third chilled chamber may be positioned beneath the full-width chilled chamber and accessible through a third chamber opening.

In another aspect of the present disclosure, a refrigerator appliance may be provided. The refrigerator appliance may include a cabinet extending along a lateral direction between a first side portion and a second side portion, as well as along a transverse direction from a rear portion to a front portion. The refrigerator appliance may further include a first door and a second door. The cabinet may define a plurality of operably-independent chilled chambers. The plurality of operably-independent chilled chambers may include a first chilled chamber, a second chilled chamber, a third chilled chamber, and a fourth chilled chamber. The first chilled chamber may be positioned at the first side portion and accessible through a first chamber opening at the front portion. The second chilled chamber may be positioned at the second side portion and accessible through a second chamber opening at the front portion. The third chilled chamber may be positioned at the first side portion beneath the first chilled chamber and accessible through a third chamber opening. The fourth chilled chamber may be positioned beneath the second chilled chamber at the second side portion and accessible through a fourth chamber opening. The first door may be rotatably attached to the cabinet at the first side portion to selectively move between a closed position and an open position, the closed position restricting access to the first chilled chamber and the third chilled chamber, the open position permitting access to the first chilled chamber and the third chilled chamber. The second door may be rotatably attached to the cabinet at the second side portion to selectively move between a closed position and an open position, the closed position restricting access to the second chilled chamber and the fourth chilled, the open position permitting access to the second chilled chamber and the fourth chilled chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
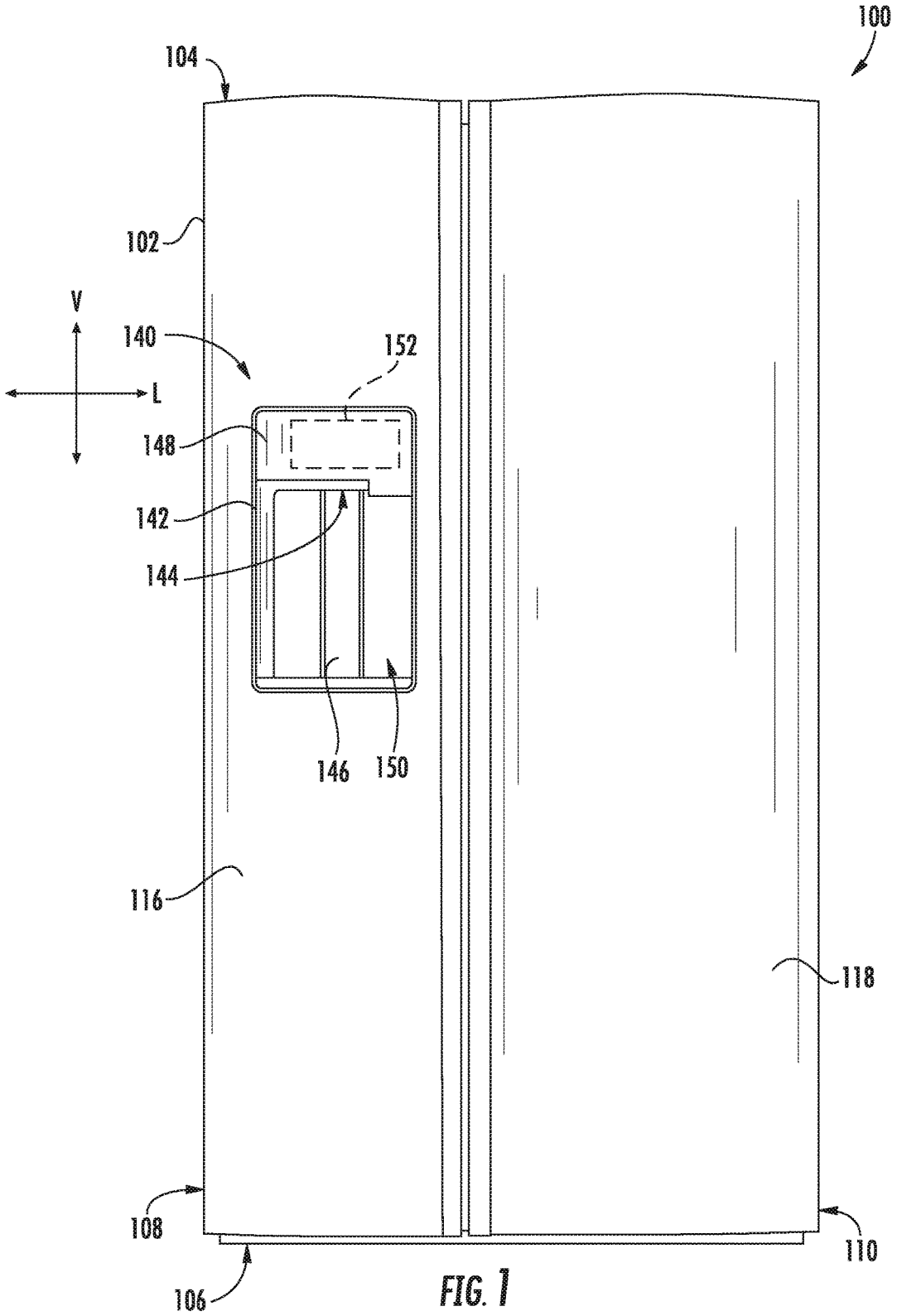
FIG. 1 provides a front view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components.

Figure 2:
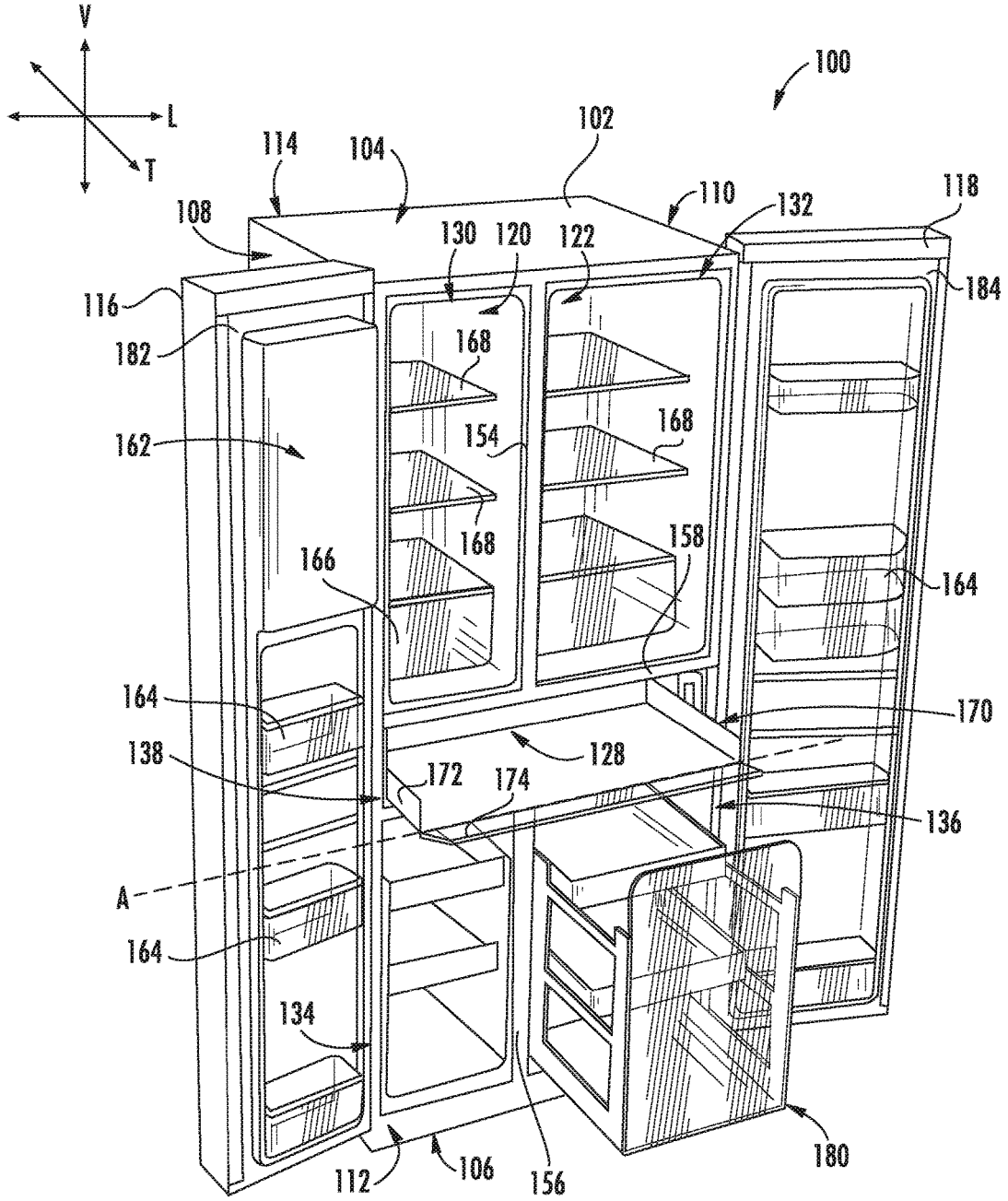
FIG. 2 provides a perspective view of the exemplary refrigerator appliance of FIG. 1 with the refrigerator doors shown in an open position.
Figure 3:
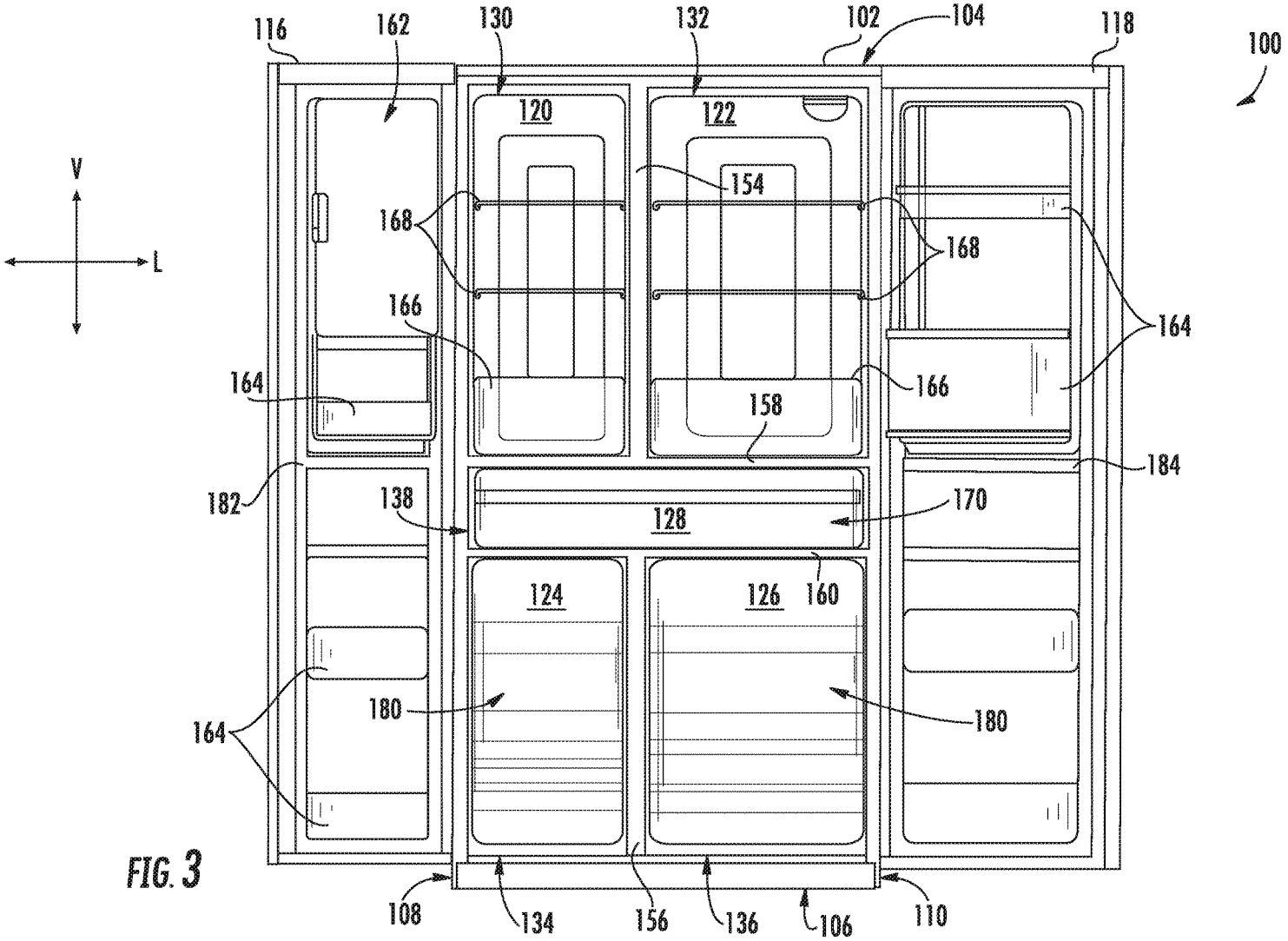
FIG. 3 provides a front view of the exemplary refrigerator appliance of FIG. 1 with the refrigerator and freezer doors shown in an open position.

Turning now to the figures, FIGS. 1 through 3 provide multiple views of a refrigerator appliance 100 according to exemplary embodiments of the present disclosure. FIG. 1 provides a front view of refrigerator appliance 100. FIG. 2 provides a perspective view of refrigerator appliance 100 with multiple doors 116, 118 shown in an open position. FIG. 3 provides a front view of refrigerator appliance 100 with doors 116, 118 shown in the open position.

Refrigerator appliance 100 generally includes a housing or cabinet 102 that extends between an upper portion 104 and a lower portion 106 along a vertical direction V, between a first side portion 108 and a second side portion 110 along a lateral direction L, and between a front portion 112 and a rear portion 114 along a transverse direction T. Each of the vertical direction V, lateral direction L, and transverse direction T are mutually perpendicular to one another.

Cabinet 102 defines a plurality of chilled chambers 120, 122, 124, 126, 128 for receipt of food items for storage. In some embodiments, cabinet 102 defines multiple discrete fresh food chambers 120, 122. For example, one or more fresh food chambers 120, 122 (e.g., a first and a second chilled chamber) may be positioned above a one or more freezer chambers 124, 126 (e.g., a third and a fourth chilled chamber). In certain embodiments, one fresh food chamber 120 is positioned at (e.g., proximal to) the first side portion 108 of the cabinet 102, while another fresh food chamber 122 is positioned at (e.g., proximal to) the second side portion 110. In further embodiments, one freezer chamber 124 is positioned at (e.g., proximal to) the first side portion 108 beneath the fresh food chamber 120, while another freezer chamber 126 is positioned at (e.g., proximal to) the second side portion 110 beneath the fresh food chamber 122.

In some embodiments, an intermediate chamber 128 (e.g., full width chamber) is positioned between the one or more fresh food chambers 120, 122 and the one or more freezer chambers 124, 126. In turn, each freezer chamber 124, 126 may be positioned directly beneath intermediate chamber 128 while each fresh food chamber 120, 122 is positioned directly above intermediate chamber 128. As shown, intermediate chamber 128 may extend from the first side portion 108 to the second side portion 110 to occupy the full internal width of cabinet 102 (e.g., such that intermediate chamber 128 has a lateral width equal to the combined lateral width of the fresh food chambers 120, 122 or freezer chambers 124, 126).

Each chilled chamber 120, 122, 124, 126, 128 is generally accessible (e.g., to add or remove items within refrigerator appliance 100 along the transverse direction T) through a separate opening 130, 132, 134, 136, 138 at the front portion 112 of cabinet 102. Specifically, one fresh food opening 130 is in communication with (and permits access to) fresh food chamber 120; one fresh food opening 132 is in communication with (and permits access to) fresh food chamber 122; an intermediate opening 138 is in communication with (and permits access to) intermediate chamber 128; one freezer opening 134 is in communication with (and permits access to) freezer chamber 124; and one freezer opening 136 is in communication with (and permits access to) freezer chamber 126.

It is understood that each chamber 120, 122, 124, 126, 128 is generally separated by one or more mullions. For example, an upper vertical mullion 154 may separate fresh food chambers 120, 122 from each other. A lower vertical mullion 156 may separate freezer chambers 124, 126 from each other. An upper horizontal mullion 158 may separate intermediate chamber 128 from the fresh food chambers 120, 122. A lower horizontal mullion 160 may separate intermediate chamber 128 from the freezer chambers 124, 126. Each mullion 154, 156, 158, 160 may be formed from an insulating material, such as foam, and extend across an internal liner of the cabinet 102. In addition, to provide structural support, a rigid injection molded liner or a metal frame may surround the insulating foam of each mullion 154, 156, 158, 160 and further separate the chambers 120, 122, 124, 126, 128. In turn, each chamber 120, 122, 124, 126, 128 may be maintained at a unique temperature (e.g., between around 0° F. and 57° F.) by one or more sealed refrigeration systems (not pictured).

Advantageously, fresh food chambers 120, 122 are provided at a comfortable and readily accessible height (e.g., such that most users will be able to view the entire height of fresh food chambers 120, 122 without bending over). Moreover, intermediate chamber 128 may be positioned at a typical waist-level position such that at least a portion of intermediate chamber 128 may advantageously be accessed without bending over.

Various doors may be mounted to cabinet 102 to selectively open and close a portion of the one or more chilled chambers 120, 122, 124, 126, 128. As an example, a pair of side-by-side French doors 116, 118 may, together, cover chilled chambers 120, 122, 124, 126, 128. In some embodiments, a first door 116 is rotatably attached to cabinet 102 at the first side portion 108 to selectively move between a closed position (FIG. 1) and an open position (FIGS. 2 and 3). The closed position of first door 116 generally restricts access to fresh food chamber 120 and freezer chamber 124. Moreover, the closed position of first door 116 may restrict access to at least a portion (e.g., one half or less than one half) of intermediate chamber 128. In further embodiments, a second door 118 is rotatably attached to cabinet 102 at the second side portion 110 to selectively move between a closed position (FIG. 1) and an open position (FIGS. 2 and 3). The closed position of second door 118 generally restricts access to fresh food chamber 122 and freezer chamber 126. Moreover, the closed position of second door 118 may restrict access to at least a portion (e.g., another half or more than one half) of intermediate chamber 128.

In order to prevent or restrict leakage of cool air, doors 116, 118 and/or cabinet 102 may define one or more sealing mechanisms at the interface where the doors 116, 118 meet cabinet 102. In some such embodiments, each door 116, 118 comprises a discrete perimeter gasket set (e.g., foam seal or rubber gasket) to sealingly engage the cabinet 102 in a closed position and isolate the corresponding chilled chamber(s) from the other chilled chambers. As an example, a first gasket set 182 may be mounted to an inner portion of first door 116 to isolate fresh food chamber 120, freezer chamber 124, and/or a portion of intermediate chamber 128 in the closed position. Specifically, in the closed position, first gasket set 182 may form a continuous seal against a perimeter portion of cabinet 102, upper vertical mullion 154, upper horizontal mullion 158, lower horizontal mullion 160, and lower vertical mullion 156. Additionally or alternatively, a second gasket set 184 may be mounted to an inner portion of second door 118 to isolate fresh food chamber 122, freezer chamber 126, and/or a portion of intermediate chamber 128 in the closed position. Specifically, in the closed position, second gasket set 184 may form a continuous seal against a perimeter portion of cabinet 102, upper vertical mullion 154, upper horizontal mullion 158, lower horizontal mullion 160, and lower vertical mullion 156.

In some embodiments, refrigerator appliance 100 also includes a dispensing assembly 140 for dispensing liquid water and/or ice (e.g., from an ice making assembly 162 mounted to door 116). Dispensing assembly 140 includes a dispenser 142 positioned on or mounted to an exterior portion of refrigerator appliance 100, e.g., on one of doors 116, 118. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs, such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is defined at a predetermined elevation convenient for a user to access ice or water and enabling the user to access ice without the need to bend-over and without the need to open doors 116, 118. In the exemplary embodiment, dispenser recess 150 is positioned at a level that approximates the chest level of a user.

Refrigerator appliance 100 further includes a controller 152. Operation of the refrigerator appliance 100 is generally regulated by controller 152. Controller 152 may be provided in communication (e.g., electrically coupled) with a panel. In exemplary embodiments, a control panel is included as general purpose I/O ("GPIO") device or functional block. In other exemplary embodiments, a control panel is included with multiple input components, such as one or more of a variety of electrical, mechanical or electro-mechanical input devices including rotary dials, push buttons, touch pads, and touch screens. The control panel may be in communication (e.g., electrically coupled) with controller 152 via one or more signal lines or shared communication busses.

Moreover, controller 152 may be in communication with a sealed refrigeration system (not pictured) directing cooling operations of refrigerator appliance 100. During use, controller 152 may initiate cooling operations (e.g., cooling airflows) within the various chilled chambers 120, 122, 124, 126, 128. Optionally, each chilled chamber 120, 122, 124, 126, 128 may be operably independent such that a discrete operating temperature may be selected for each chilled chamber 120, 122, 124, 126, 128. For instance, refrigerator appliance 100 is able to maintain one freezer chamber 124, at separate temperature from another freezer chamber 126. Additionally or alternatively, fresh food chambers 120, 122 and intermediate chamber 128 may each be maintained at separate or unique temperatures from the other chilled chambers.

In some embodiments, controller 152 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes non-transitive programming instructions stored in the memory. The memory can be a separate component from the processor or can be included onboard within the processor. Alternatively, controller 152 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

According to the illustrated embodiments, various storage components are mounted within fresh food chambers 120, 122 and freezer chambers 124, 126 to facilitate storage of food items therein as will be understood by those skilled in the art. In particular, the storage components include bins 164, drawers 166, and shelves 168 that are mounted within fresh food chambers 120, 122 and/or freezer chambers 124, 126. Bins 164, drawers 166, and shelves 168 are configured for receipt of food items (e.g., beverages and/or solid food items) and may assist with organizing such food items. A separate intermediate drawer assembly 170 may be mounted within intermediate chamber 128. Additionally or alternatively, one or both of freezer chambers 124, 126 may have a separate bottom drawer assembly 180 mounted therein.

In some embodiments, intermediate drawer assembly 170, including an intermediate drawer 172, is slidably disposed within intermediate chamber 128. In other words, intermediate drawer assembly 170 may slide along the transverse direction T between a covered position (FIG. 3) and an uncovered position (FIG. 2). As illustrated, the covered position of intermediate drawer assembly 170 may generally provide intermediate drawer 172 within (e.g., enclosed by) intermediate chamber 128. Access to items within intermediate drawer 172, and intermediate chamber 128 generally, may be restricted in the covered position. By contrast, in the uncovered position, at least a portion of intermediate drawer 172 may extend from intermediate chamber 128, such that a user may advantageously view and/or access any items within intermediate drawer 172 and/or intermediate chamber 128 without bending over.

As illustrated in FIGS. 2 and 3, in certain embodiments, intermediate drawer 172 includes a forward wall or panel 174 positioned proximal to the intermediate opening 138 in the covered position of intermediate drawer assembly 170. In turn, when intermediate drawer 172 is in the covered position, forward panel 174 generally extends across intermediate opening 138, thereby restricting access to intermediate chamber 128. Optionally, forward panel 174 may be pivotably mounted on intermediate drawer 172. Specifically, forward panel 174 may be pivotable about a pivot axis A. As shown, pivot axis A may be parallel to the lateral direction L such that forward panel 174 may be selectively pivoted from an upright vertical position (FIG. 3) to an outward horizontal position (FIG. 2) permitting greater access to intermediate drawer 172.

Turning now to FIGS. 4 through 7, an exemplary intermediate drawer 200 is illustrated for use within an intermediate drawer assembly 170 of refrigerator appliance 100 (FIGS. 1 through 3). It is understood that intermediate drawer 200 may be generally embodied as intermediate drawer 172, or as an alternative thereto.

As shown, intermediate drawer 200 includes a drawer frame 202 having a plurality of side panels 204 extending (e.g., in the vertical direction V) from a base panel 206 to define a storage volume 208. In certain embodiments, a forward panel 210 is mounted to drawer frame 202 to further define storage volume 208. As shown, forward panel 210 may extend (e.g., in the vertical direction V) at a transverse extreme of intermediate drawer 200. In some such embodiments, forward panel 210 may be formed as transparent member (e.g., from a transparent glass or plastic material). Additionally or alternatively, forward panel 210 may be formed to complement intermediate opening 138 (FIG. 2). In turn, forward panel 210 may extend across and/or in front of intermediate opening 138 in a covered position.

In optional embodiments, intermediate drawer 200 includes one or more sliding segments 212, 214, 216 that can slide independently of each other and/or another portion of drawer frame 202. For instance, a first sliding segment 212 and a second sliding segment 214 may be slidably mounted on base panel 206. As shown, each sliding segment may include a secondary floor 218 fixed relative to a portion of forward panel 210 to slide in the transverse direction T relative to (e.g., on top of or below) base panel 206. Optionally, a secondary sidewall 220 may be further fixed relative to a portion of forward panel 210 to similarly slide in the transverse direction T relative to (e.g., on top of or below) a respective side panel 204. When assembled within refrigerator appliance 100 (FIG. 3), it is understood that first sliding segment 212 may be positioned proximal to first side portion 108 (i.e., distal to second side portion 110) while second sliding segment 214 is positioned proximal to second side portion 110 (i.e., distal to first side portion 108). In some such embodiments, first sliding segment 212 is covered by first door 116 (FIG. 2) in its closed position while second sliding segment 214 is covered by second door 118 (FIG. 2) in its closed position. Moreover, first and second sliding segments 212, 214 may be independently slidable relative to each other such that one sliding segment (e.g., first sliding segment 212) may selectively slide through (e.g., extend from) intermediate opening 138 (FIG. 3) without moving or affecting the position of second sliding segment 214.

Figure 7:
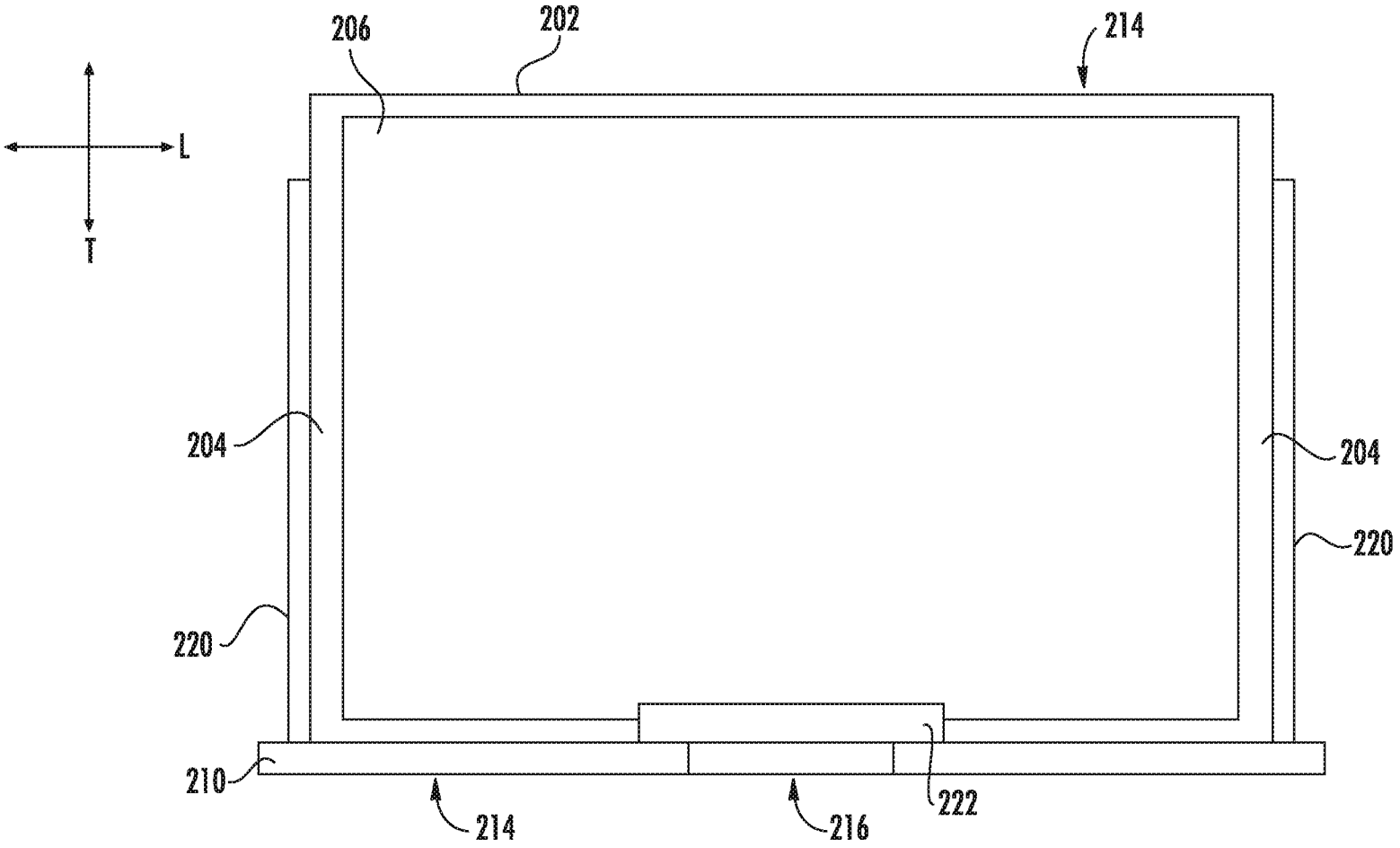
FIG. 7 provides a bottom plan view of the exemplary intermediate drawer of FIG. 4.

As shown, first and second sliding segments 212, 214 may be spaced apart from each other along the lateral direction L. In some such embodiments, a central sliding segment 216 is positioned between first sliding segment 212 and second sliding segment 214 along the lateral direction L. As illustrated in FIG. 7, central sliding segment 216 may include a lateral catch 222, e.g., mounted to a bottom surface thereof. Lateral catch 222 may generally extend along the lateral direction L from central sliding segment 216 behind forward panel 210 (e.g., relative to the transverse direction T). In turn, lateral catch 222 may selectively engage first and second sliding segments 212, 214 (e.g., at the forward panel 210 portions thereof) as central sliding segment 216 is moved forward along the transverse direction T. Thus, lateral catch 222 may ensure synchronized movement of the sliding segments 212, 214 when central sliding segment 216 is moved forward, while otherwise permitting independent transverse movement of the sliding segments 212, 214.

Figure 4:
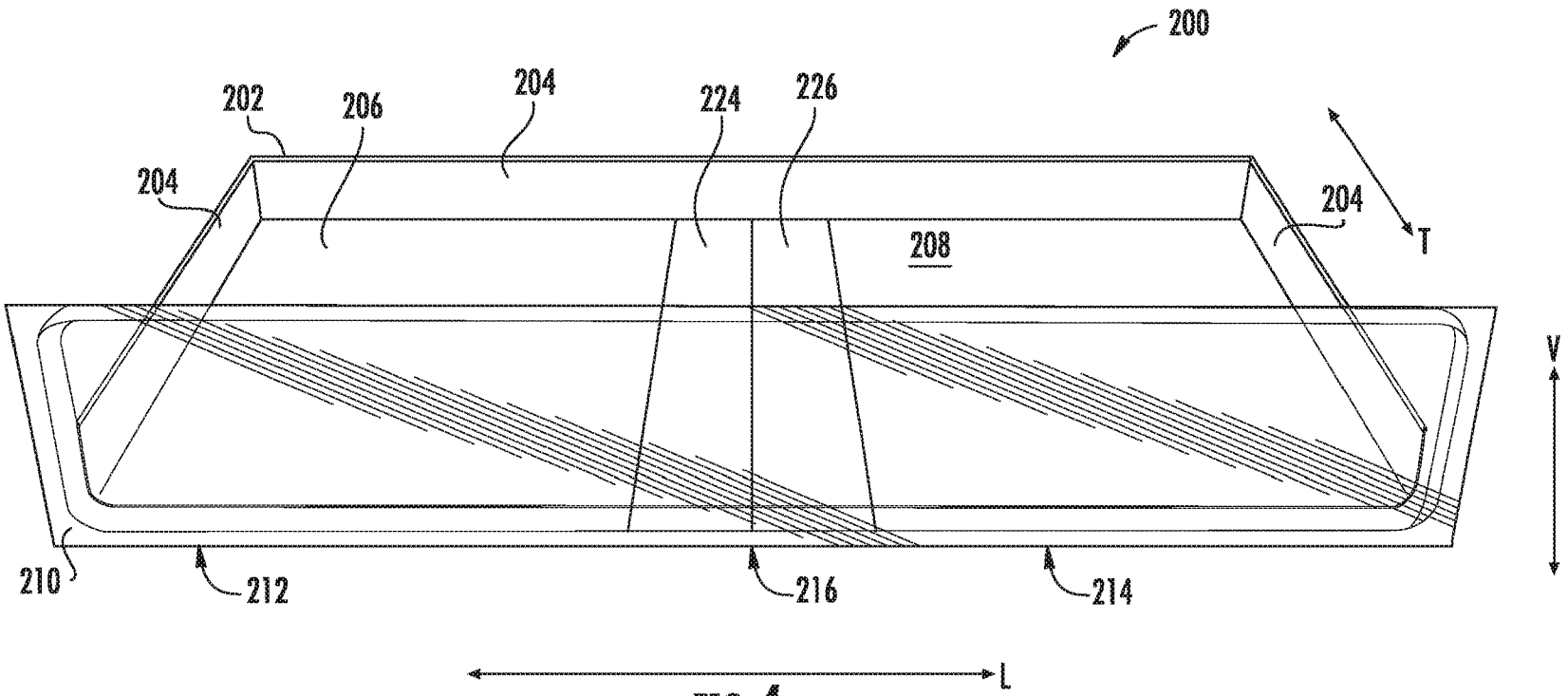
FIG. 4 provides a perspective top view of an intermediate drawer of a refrigerator appliance according to exemplary embodiments of the present disclosure.
Figure 5:
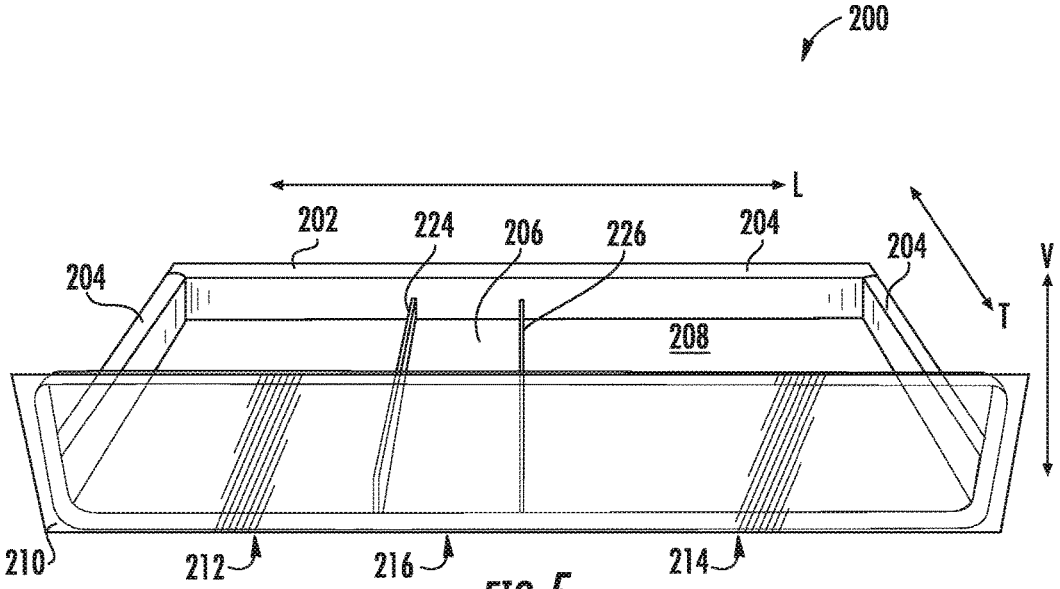
FIG. 5 provides a perspective top view of the exemplary intermediate drawer of FIG. 4 with a pair of partitions in an upright position.
Figure 6:
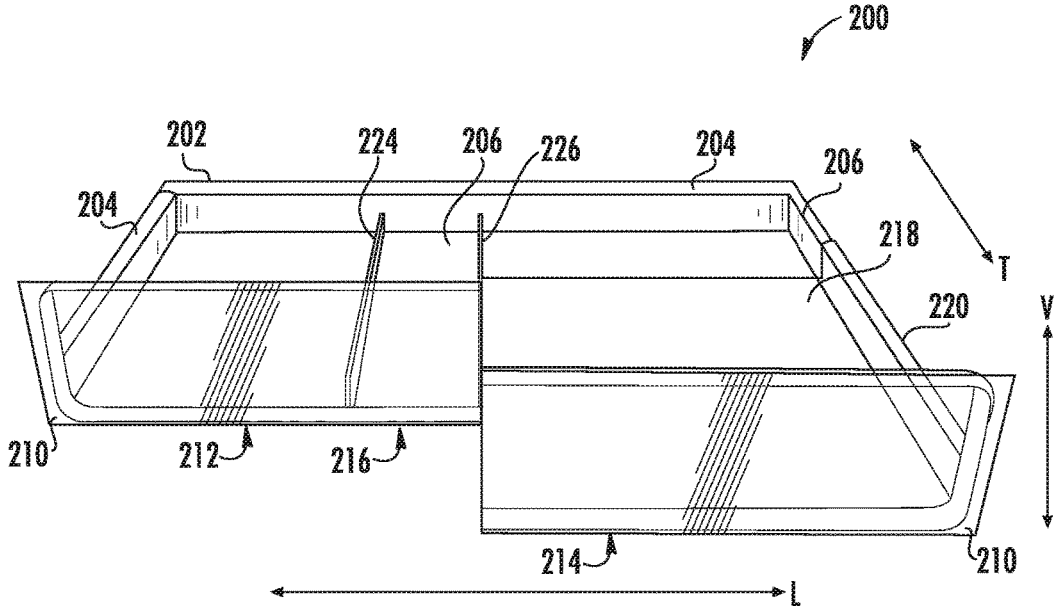
FIG. 6 provides a perspective top view of the exemplary intermediate drawer of FIG. 5 with sliding segment in a forward position.

Additionally or alternatively, as shown in FIGS. 4 through 6, one or more partitions 224, 226 may be selectively positioned between one or more of the segments 212, 214, 216 in the lateral direction L. As shown, when positioned between two sliding segments (e.g., between central sliding segment 216 and first sliding segment 212) a partition 224 may generally extend in the vertical direction V from base panel 206 and along the transverse direction T from a rearmost side panel 204 along the transverse direction T. Thus, each partition 224, 226 may serve to separate or isolate two portions of storage volume 208. Moreover, a partition 224, 226 may advantageously hold items within one or more sliding segments (e.g., central sliding segment 216 and/or first sliding segment 212) as another sliding segment (e.g., second sliding segment 214) is moved relative thereto. In optional embodiments, each partition 224, 226 may be pivotally mounted to a sliding segment 212, 214, or 216 (e.g., at base panel 206 or secondary floor 218). For instance a first partition 224 and a second partition 226 may be pivotally mounted to central sliding segment 216 to selectively separate the first sliding segment 212 and the second sliding segment 214, respectively. The first and second partitions 224, 226 may selectively pivot or fold (e.g., about an axis parallel to the transverse direction T) between a flat non-separating position (FIG. 4) and an upright separating position (FIGS. 5 and 6).

Figure 8:
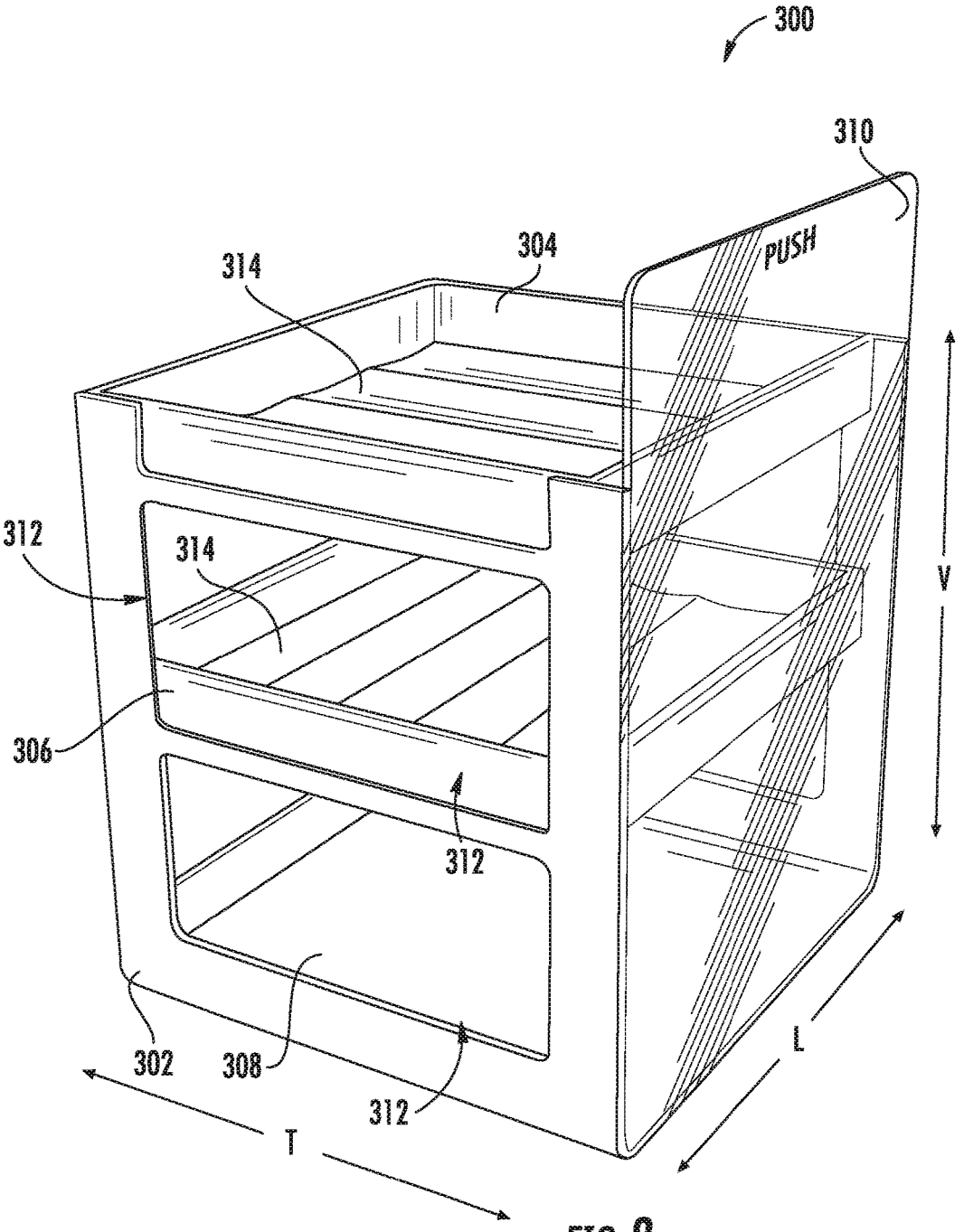
FIG. 8 provides a perspective view of a bottom drawer of a refrigerator appliance according to exemplary embodiments of the present disclosure.
Figure 9:
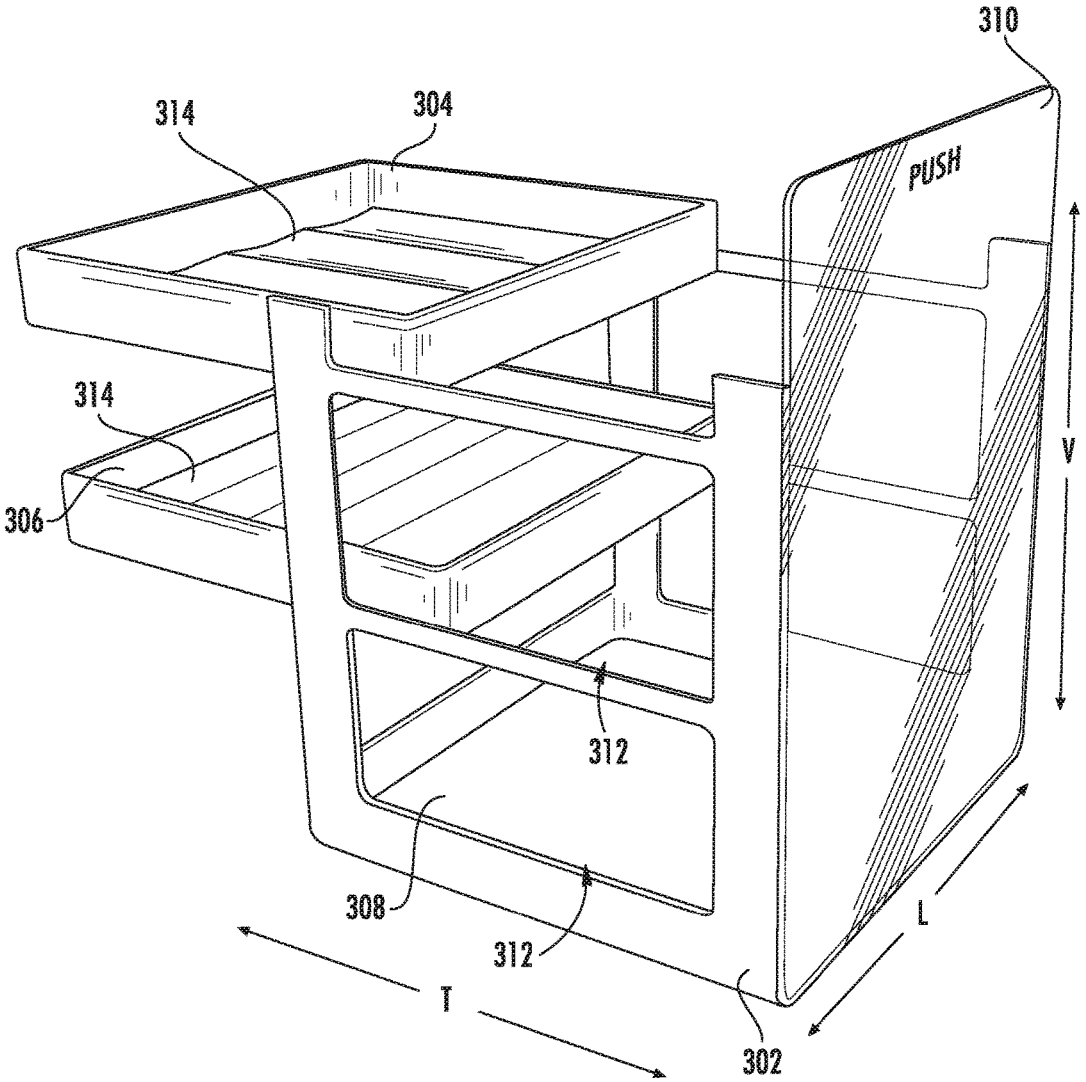
FIG. 9 provides a perspective view of the exemplary bottom drawer of the FIG. 9 with an upper and a middle shelf in a rearward position.

Turning now to FIGS. 8 through 9, an exemplary bottom drawer 300 is illustrated for use within bottom drawer assembly 180 of refrigerator appliance 100 (FIGS. 1 through 3). It is understood that bottom drawer 300 may be generally embodied as a portion of bottom assembly 180, or as an alternative thereto.

As shown, bottom drawer 300 includes a pantry drawer frame 302 supporting a plurality of shelves 304, 306, 308. A fixed panel 310 may be mounted to pantry drawer frame 302 and extend therealong (e.g., in the vertical direction V) at a transverse extreme of pantry drawer frame 302. In some such embodiments, fixed panel 310 may be formed as transparent member (e.g., from a transparent glass or plastic material). Additionally or alternatively, fixed panel 310 may be formed to complement a corresponding freezer opening 134 or 136 (FIG. 2). In turn, fixed panel 310 may extend across and/or in front of freezer opening 134 or 136 in a covered position.

Returning briefly to FIGS. 2 and 3, pantry drawer frame 302 (e.g., as part of bottom drawer assembly 180) may slide along the transverse direction T between a covered position (FIG. 2) and an uncovered position (FIG. 3). The covered position of bottom drawer assembly 180 may generally provide a bottom drawer frame within (e.g., enclosed by) a corresponding freezer chamber 124 or 126. Access to items within bottom drawer 180, and freezer chamber 124 or 126 generally, may be restricted in the covered position. By contrast, in the uncovered position, at least a portion of bottom drawer 180 may extend from freezer chambers 124, 126, such that a user may view and/or access any items within bottom drawer 180 and/or freezer chambers 124, 126.

Returning now to FIGS. 8 and 9, one or more of shelves (e.g., 304 and/or 306) may be slidably mounted on pantry drawer frame 302. In certain embodiments, an upper shelf 304 and/or a middle shelf 306 are independently slidable along the transverse direction T (e.g., relative to the pantry drawer frame 302). Thus, each of the upper shelf 304 and the middle shelf 306 may move separately from the pantry drawer frame 302 between a respective forward position (FIG. 8) and a rearward position (FIG. 9). Additionally or alternatively, pantry drawer frame 302 may define one or more lateral apertures 312 in parallel alignment with a corresponding shelf 304, 306, or 308. Advantageously, a user may thus laterally access and/or view one or more of the shelves (e.g., 306 or 308) without moving one or more slidable shelves (e.g., upper and middle shelves 304, 306) relative to the pantry drawer frame 302.

Figure 10:
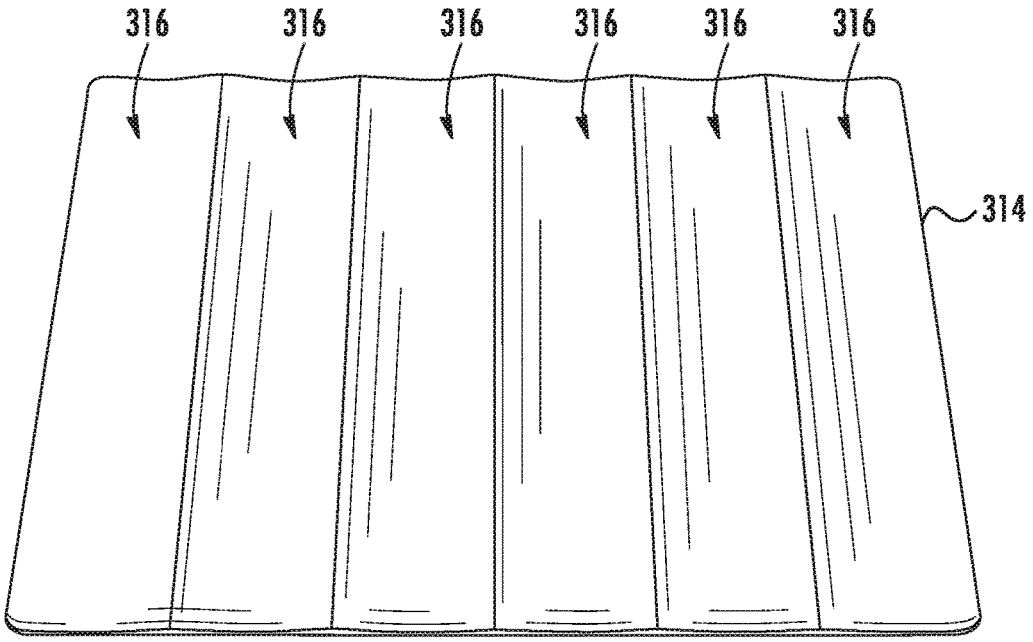
FIG. 10 provides a top perspective view of one support mat of the exemplary bottom drawer of FIG. 8.
Figure 11:
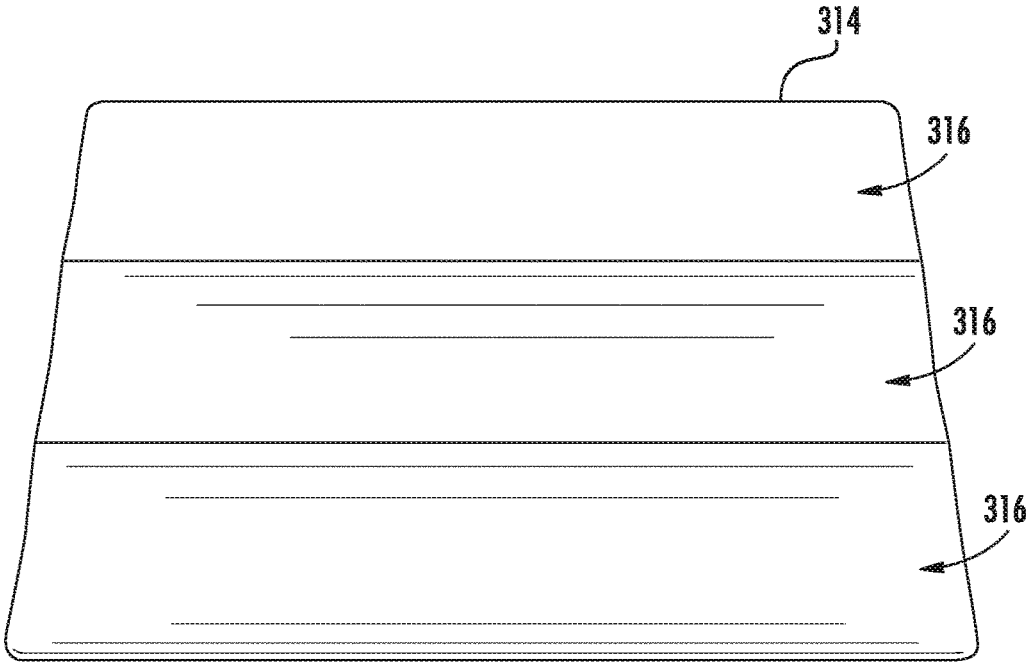
FIG. 11 provides a top perspective view of another support mat of the exemplary bottom drawer of FIG. 8.

As shown in FIGS. 8 through 10, some embodiments may include one or more removable mats 314 to be supported on shelves 304, 306, 308. In turn, mats 314 may be sized to complement a corresponding shelf 304, 306, or 308 such that, for example, each mat 314 occupies the entire footprint of the corresponding shelf 304, 306, or 308. Moreover, each mat 314 may define one or more channels 316. Advantageously, the channels 316 may be configured to receive one or more complementary curved items, such as a wine bottle or soda can. Additionally or alternatively, the channels 316 may advantageously improve airflow about one or more food items (e.g., vegetables) placed thereon. In optional embodiments, a removable mat 314 may be reversible. One side may include channels 316 defined at a specific curved radius, as shown in FIG. 10, while the other side includes channels 316 defined at another unique curved radius, as shown in FIG. 11.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a transverse direction, and a lateral direction defining a mutually orthogonal direction system, the refrigerator appliance comprising:

a cabinet extending along the lateral direction between a first side portion and a second side portion, the cabinet extending along the transverse direction from a rear portion to a front portion, the cabinet defining a plurality of operably-independent chilled chambers, the plurality of operably-independent chilled chambers comprising a first chilled chamber positioned at the first side portion and accessible through a first chamber opening at the front portion, a second chilled chamber positioned at the second side portion and accessible through a second chamber opening at the front portion, a full-width chilled chamber extending from the first side portion to the second side portion beneath the first chilled chamber and the second chilled chamber along the vertical direction, and a third chilled chamber positioned beneath the full-width chilled chamber and accessible through a third chamber opening;

a drawer assembly slidably disposed within the full-width chilled chamber from the first side portion to the second side portion, the drawer assembly being movable between a covered position restricting access to the full-width chilled chamber and an uncovered position permitting access to the full-width chilled chamber, the drawer assembly comprising a first sliding segment proximal to the first side portion and a second sliding segment proximal to the second side portion, wherein the first sliding segment and the second sliding segment are independently slidable in the transverse direction through a full-width chamber opening; and a partition pivotally mounted to the drawer assembly between the first sliding segment and the second sliding segment.

2. The refrigerator appliance of claim 1, wherein the plurality of operably independent chambers further comprises a fourth chilled chamber positioned beneath the full-width chilled chamber at the second side portion and accessible through a fourth chamber opening, and wherein the third chilled chamber is positioned at the first side portion.

3. The refrigerator appliance of claim 2, further comprising:

a first door rotatably attached to the cabinet at the first side portion to selectively move between a closed position and an open position, the closed position restricting access to the first chilled chamber, the third chilled, and one portion of the full-width chilled chamber, the open position permitting access to the first chilled chamber, the third chilled chamber, and the one portion of the full-width chilled chamber; and a second door rotatably attached to the cabinet at the second side portion to selectively move between a closed position and an open position, the closed position restricting access to the second chilled chamber, the fourth chilled, and another portion of the full-width chilled chamber, the open position permitting access to the second chilled chamber, the fourth chilled chamber, and the another portion of the full-width chilled chamber.

4. The refrigerator appliance of claim 3, wherein a first gasket set is mounted to an inner portion of the first door to isolate the first chilled chamber, the third chilled chamber, and the one portion of the full-width chilled chamber in the closed position, and wherein a second gasket set is mounted to an inner portion of the second door to isolate the second chilled chamber, the fourth chilled chamber, and the another portion of the full-width chilled chamber in the closed position.

5. The refrigerator appliance of claim 1, wherein the drawer assembly comprises a forward panel extending across a full-width chamber opening at the front portion in the covered position, the front panel being pivotable about a pivot axis parallel to the lateral direction.

6. The refrigerator appliance of claim 1, wherein the drawer assembly further comprises a central sliding segment positioned between the first and second sliding segments along the lateral direction, wherein the central sliding segment comprises a lateral catch selectively engaged with the first and second sliding segments in synchronized movement in the transverse direction.

7. The refrigerator appliance of claim 6, wherein the partition is selectively positioned between the central sliding segment and the first sliding segment or the second sliding segment.

8. The refrigerator appliance of claim 7, wherein the partition is pivotally mounted to the central sliding segment.

9. The refrigerator appliance of claim 1, further comprising a pantry drawer frame selectively disposed within the third chilled chamber, and a plurality of shelves slidably disposed on the pantry drawer frame.

10. The refrigerator appliance of claim 9, wherein the pantry drawer frame defines a lateral aperture permitting lateral access to a slidable shelf.

11. A refrigerator appliance defining a vertical direction, a transverse direction, and a lateral direction defining a mutually orthogonal direction system, the refrigerator appliance comprising:

a cabinet extending along the lateral direction between a first side portion and a second side portion, the cabinet extending along the transverse direction from a rear portion to a front portion, the cabinet defining a plurality of operably-independent chilled chambers, the plurality of operably-independent chilled chambers comprising a first chilled chamber positioned at the first side portion and accessible through a first chamber opening at the front portion, a second chilled chamber positioned at the second side portion and accessible through a second chamber opening at the front portion, a third chilled chamber positioned at the first side portion beneath the first chilled chamber and accessible through a third chamber opening, a fourth chilled chamber positioned beneath the second chilled chamber at the second side portion and accessible through a fourth chamber opening, and a full-width chilled chamber extending from the first side portion to the second side portion, the full-width chilled chamber being defined beneath the first and second chilled chambers and above the fourth and fifth chilled chambers along the vertical direction;

a first door rotatably attached to the cabinet at the first side portion to selectively move between a closed position and an open position, the closed position restricting access to the first chilled chamber and the third chilled chamber, the open position permitting access to the first chilled chamber and the third chilled chamber;

a second door rotatably attached to the cabinet at the second side portion to selectively move between a closed position and an open position, the closed position restricting access to the second chilled chamber and the fourth chilled, the open position permitting access to the second chilled chamber and the fourth chilled chamber;

a drawer assembly slidably disposed within the full-width chilled chamber from the first side portion to the second side portion, the drawer assembly being movable between a covered position restricting access to the full-width chilled chamber and an uncovered position permitting access to the full-width chilled chamber, the drawer assembly comprising a first sliding segment proximal to the first side portion and a second sliding segment proximal to the second side portion, wherein the first sliding segment and the second sliding segment are independently slidable in the transverse direction through a full-width chamber opening; and a partition pivotally mounted to the drawer assembly between the first sliding segment and the second sliding segment.

12. The refrigerator appliance of claim 11, further comprising a pantry drawer frame selectively disposed within the third chilled chamber or the fourth chilled chamber, and a plurality of shelves slidably disposed on the pantry drawer frame.

13. The refrigerator appliance of claim 12, wherein the pantry drawer frame defines a lateral aperture permitting lateral access to a slidable shelf.

14. The refrigerator appliance of claim 12, wherein the plurality of operably independent chambers further comprises a full-width chilled chamber extending from the first side portion to the second side portion, the full-width chilled chamber being defined beneath the first and second chilled chambers and above the fourth and fifth chilled chambers along the vertical direction.

15. The refrigerator appliance of claim 11, wherein the first sliding segment is covered by the first door in the closed position and the second sliding segment is covered by the second door in the closed position.

16. The refrigerator appliance of claim 15, wherein the drawer assembly further comprises a central sliding segment positioned between the first and second sliding segments along the lateral direction, wherein the central sliding segment comprises a lateral catch selectively engaged with the first and second sliding segments in synchronized movement along the transverse direction.

17. The refrigerator appliance of claim 16, wherein the partition is selectively positioned between the central sliding segment and the first sliding segment or the second sliding segment.

18. The refrigerator appliance of claim 11, wherein a first gasket set is mounted to an inner portion of the first door to isolate the first chilled chamber, the third chilled chamber, and the one portion of the full-width chilled chamber in the closed position, and wherein a second gasket set is mounted to an inner portion of the second door to isolate the second chilled chamber, the fourth chilled chamber, and the another portion of the full-width chilled chamber in the closed position.

* * * * *